United States Patent [19]

Loftus et al.

[11] 4,326,738

[45] Apr. 27, 1982

[54] DOOR KNOBS AND LEVERS

[76] Inventors: Barry N. Loftus, 15 Willsmere Rd., North Kew, Victoria; Hugh J. Young, 2 Ormond St., Kensington, Victoria, both of Australia

[21] Appl. No.: 35,691

[22] Filed: May 3, 1979

[51] Int. Cl.[3] ..... E05C 1/16

[52] U.S. Cl. ..... 292/172; 292/3361.3

[58] Field of Search ..... 292/172, 142, 336.3, 292/347, 112, 199

[56] References Cited

U.S. PATENT DOCUMENTS 352,617 11/1886 Ives ..... 292/199 X 2,731,821 1/1956 Lloyd ..... 292/199 X 3,338,613 8/1967 Kendrick ..... 292/347

*Primary Examiner*—Richard E. Moore

*Attorney, Agent, or Firm*—Silverman, Cass & Singer, Ltd.

[57] ABSTRACT

This invention discloses door furniture such as door handles and the like for actuating a spindle operated door lock. The furniture includes a first component (2) which in use is fixedly mounted relative to the face of a door and a second component (4) which is movable relative to the first component, and a coupler (10) for coupling the second component to the spindle of the lock. The first component is located within the second component. Normally the second component includes a handle.

34 Claims, 6 Drawing Figures

DOOR KNOBS AND LEVERS

BACKGROUND OF THE INVENTION

This invention relates to door knobs or door furniture, particularly door furniture which is arranged to operate the spindle of a conventional door lock. The invention also provides a door lock assembly which includes the combination of the door furniture and the spindle operated door lock and door locks operated by rack and pinion gears.

Conventionally, such mechanisms are provided with circular, rectilinear or other shaped escutcheon plates which are screwed to the door, the lever or knob being fixed to the lock spindle which extends through the door. Normally, the escutcheon plates are provided with bearings which support the lever or knob so that it can be rotated to operate the spindle of the lock. There is in use considerable stress placed upon such bearings and it is the general object of the invention to provide a new form of door furniture which avoids this stress concentration.

SUMMARY OF THE INVENTION

According to the present invention there is provided door furniture for actuating a spindle operated door lock said furniture comprising a first component which in use is fixedly mounted relative to the face of a door and a second component which is movable relative to the first component, coupling means for coupling the second component to the spindle of the lock characterized in that the first component is located within the second component.

Preferably, the first component includes a cylindrical bearing surface which engages a complementary surface formed on the interior of the second component, the second component being rotatable about the axes of said surfaces.

Door furniture of this configuration has the advantage that the bearing surfaces can be of relatively large diameter i.e. of approximately the same diameter as a conventional door knob (and thus the diameter of the cylindrical bearing surfaces can be of the order of 30 to 70 mm. but preferably is about 55 mm.).

BRIEF DESCRIPTION OF THE DRAWINGS

The invention will now be further described with reference to the accompanying drawings, in which.

DESCRIPTION OF THE PREFERRED EMBODIMENTS

Figure 1:
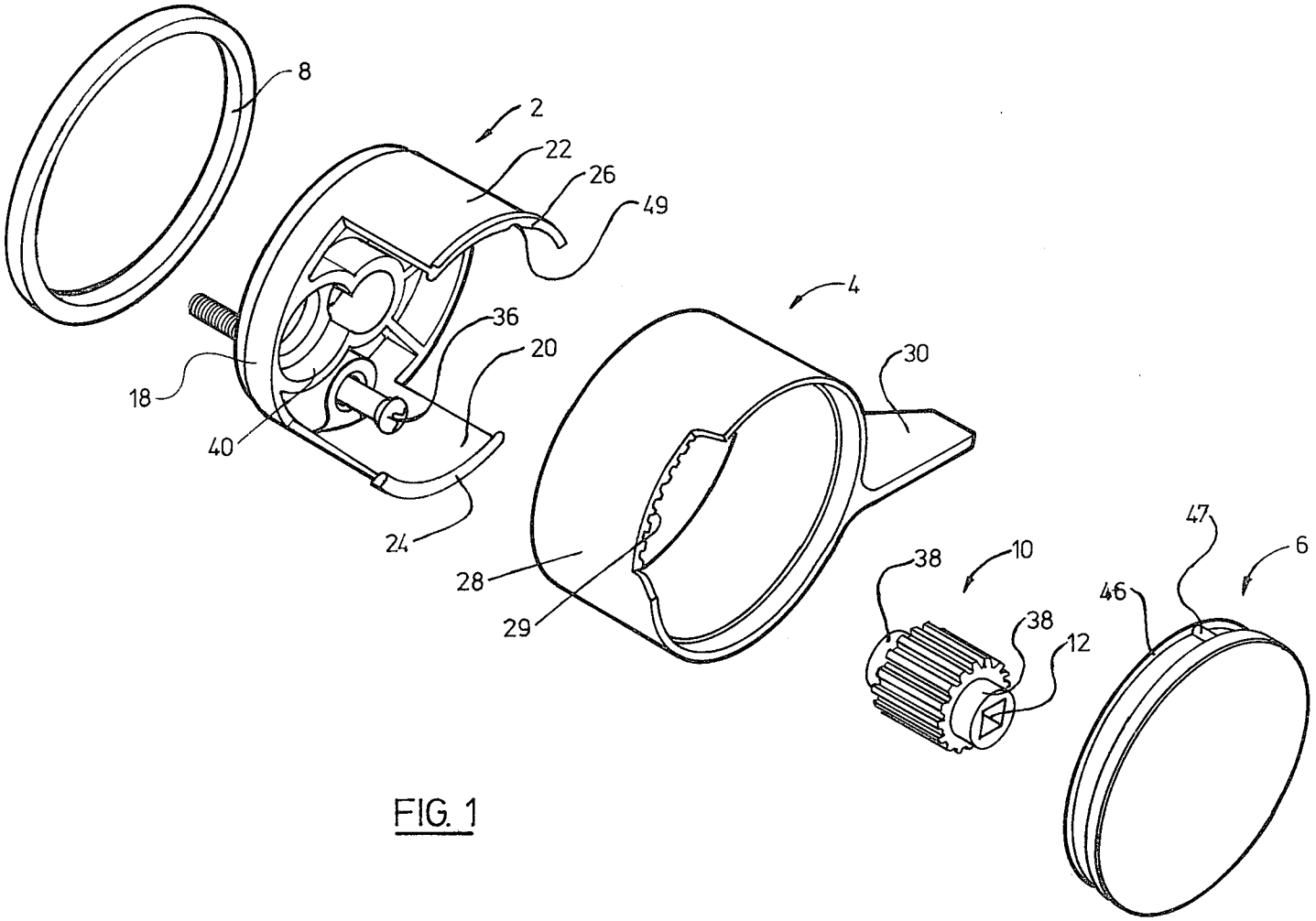
FIG. 1 is an exploded view of one embodiment of door furniture constructed in accordance with the invention.

The door furniture illustrated in FIG. 1 comprises a first component 2 which in use is fixedly mounted relative to the face of a door, a second component 4 which functions as a door handle and is mounted over the first component and retained there by means of a locking cap 6. In the illustrated arrangement a spacing ring 8 is provided and this is located in a rabbet between the inner face of the second component 4 and the face of the door. The furniture further includes an operating gear 10 which in use is mounted for rotation within the first component 2, the gear member 10 being provided with a square section recess 12 which in use receives a spindle 14 (see FIGS. 2 and 3) of a mortice lock 16.

The first component is preferably molded from plastics material and comprises a disc shaped inner portion 18 having two arcuate projections 20 and 22 extending from the periphery thereof, the outer ends of the projections 20 and 22 being provided with projecting lips 24 and 26. The second component 4 comprises a hollow cylindrical body 28 having a handle 30 projecting therefrom. The inner surface of the body 28 is provided with teeth 29 which are complementary to those of the operating gear 10 whereby rotation of the second component 4 causes rotation of the gear 10 in the same sense. Thus, rotation of the second component 4 operates the mortice lock 16. The handle 30 is not essential since the body 28 may function like a conventional door knob.

Figure 3:
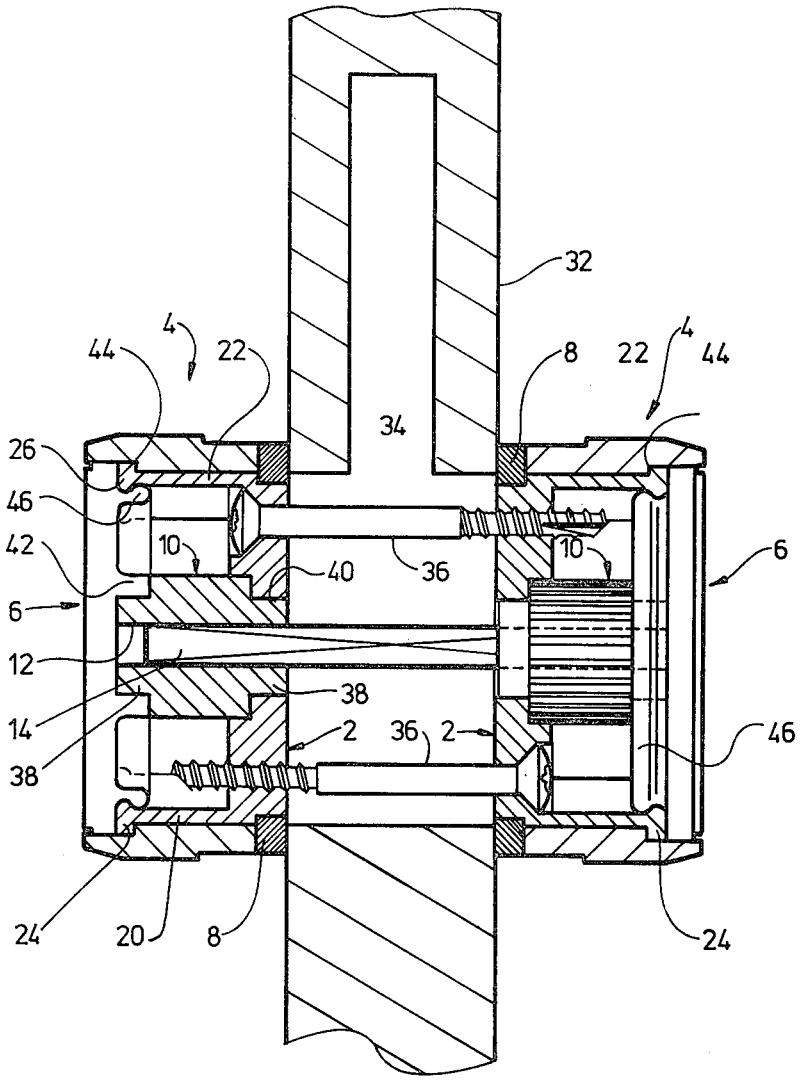
FIG. 3 is a cross-sectional view taken along the line 3—3 marked on FIG. 2.

As best seen in FIG. 3, the door furniture illustrated in FIG. 1 is located on either side of a door 32 formed with a single hole 34 through which the spindle 14 of the lock 16 passes and for mounting the door furniture. In this arrangement, a pair of screws 36 are provided to extend between and firmly interconnect the first components 2 and the spacing rings 8 bearing against the face of the door adjacent to the hole 34 to thereby mount the first components 2 fixedly with respect to the door 32. Once the first components 2 are in position, the gear members 10 are inserted over the projecting ends of the spindle 14 of the mortice lock, each gear member 10 having cylindrical end portions 38 which are received in complementary sockets 40 and 42 formed in the first member 2 and end cap 6 respectively. The second members 4 are then located over the projections 20 and 22 of the first members and are retained in position by means of the lips 24 and 26 which engage shoulders 44 formed on the interior surface of the second components 4. The furniture is completed by pressing the end caps 6 into the ends of the second components 4 so that an annular projecting rib 46 engages the lips 24 and 26 to thereby retain the end caps in position. The edge of each end cap 6 includes a rib 47 which in use engages a slot 49 formed in the inner face of the lip 26 to thereby prevent rotation of the end cap 6 relative to the first component 2. The inner face of the cylindrical body 28 may include inwardly directed projections (not shown) which engage the edges of the projections 20 and 22 and thereby serve to limit the degree of rotation of the second component 4.

Of course, other arrangements such as screws or posts or the like could be used to interconnect the first members 2 with the end caps 6. The illustrated arrangement has the advantage that there are no visible fastening means such as screws or the like. The cylindrical body 28 may be provided with an access hole through which a lever can be passed to press against the inner face of the end cap 6 to thereby remove it.

It will be appreciated from FIG. 3 that the second component 4 which is rotatable relative to the first component 2 is supported by a number of relatively large diameter cylindrical surfaces which function as bearings. In particular, such surfaces include the cylindrical outer surface of the disc portion 18 of the first component 2, the outer surfaces of the projections 20 and 22, the edges of the end caps 6 and the outer faces of the spacing rings 8. Such an arrangement avoids any areas of stress concentration and permits the use of molded plastic components.

Figure 2:
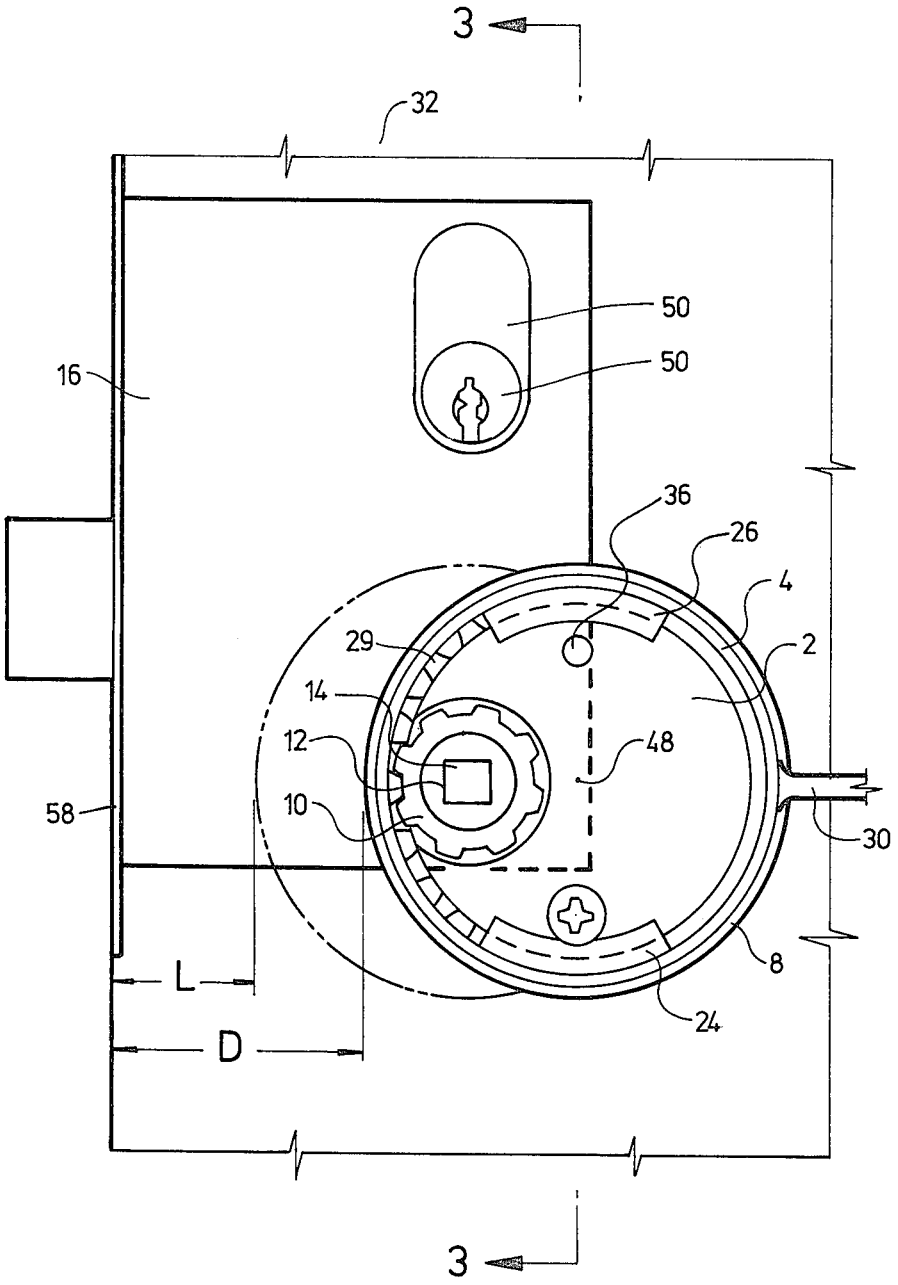
FIG. 2 is a schematic side view illustrating the use of the furniture shown in FIG. 1.
Figure 4:
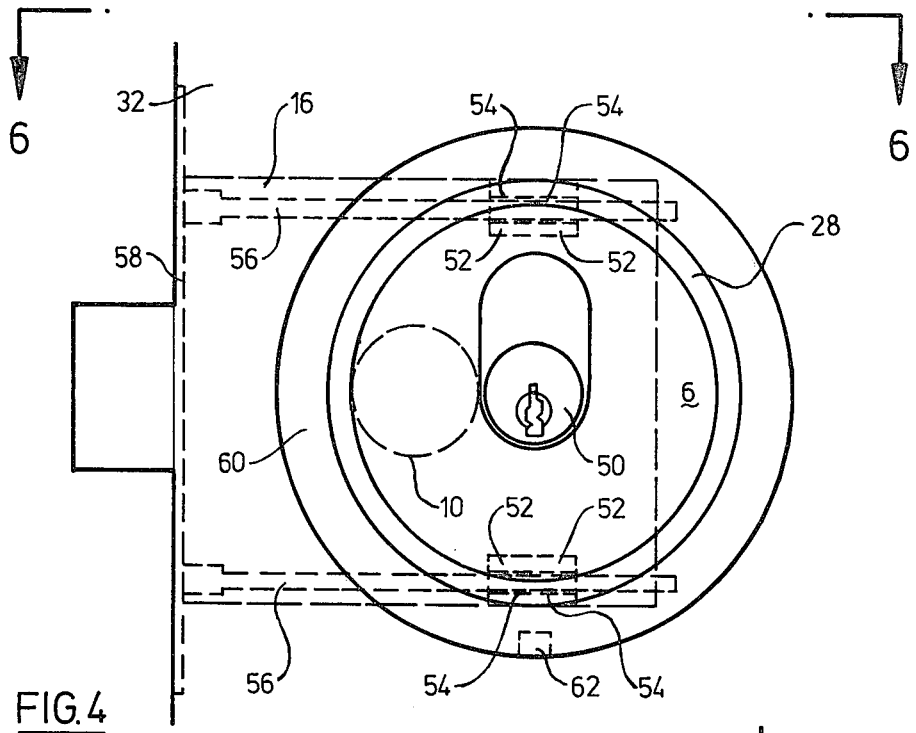
FIG. 4 is a similar view to FIG. 2 but illustrating a slightly modified embodiment of the invention.
Figure 5:
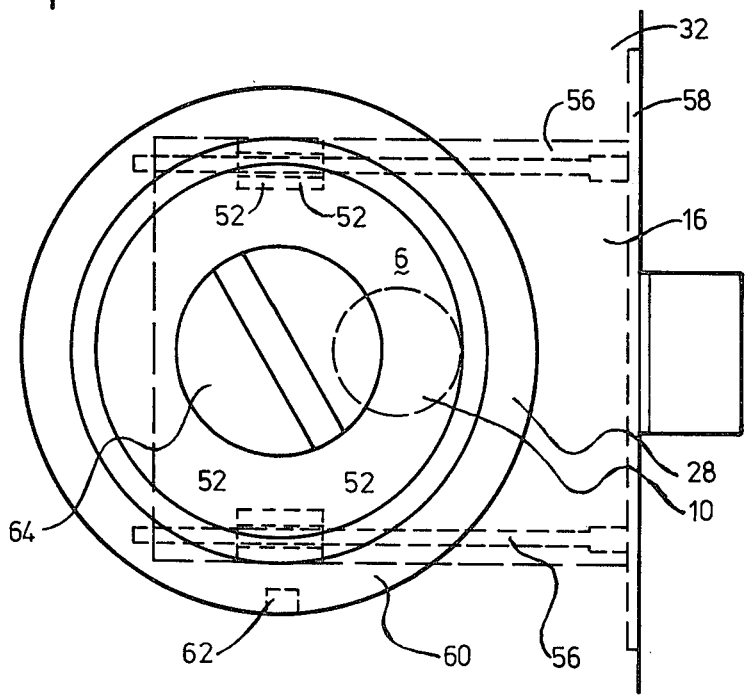
FIG. 5 illustrates the indoor side of the door furniture shown in FIG. 4.
Figure 6:
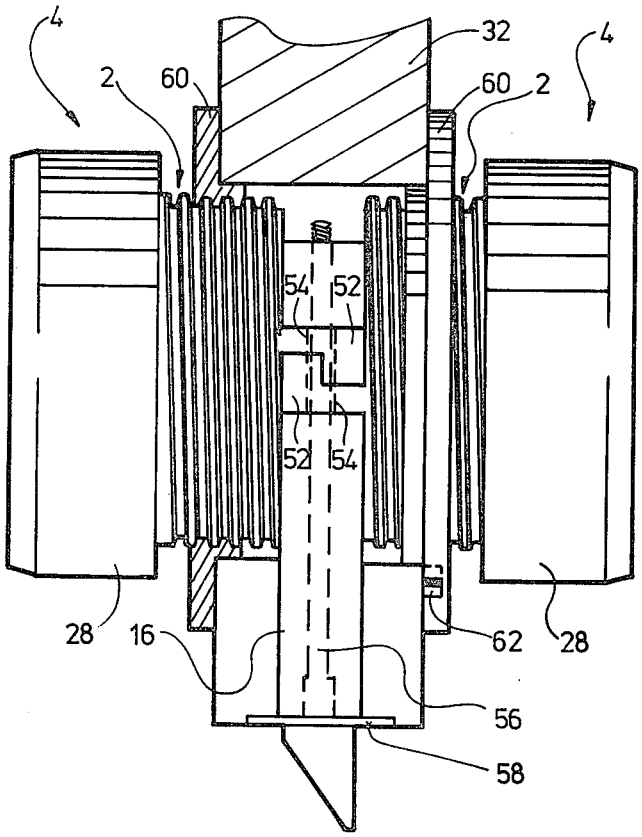
FIG. 6 is a cross-sectional view taken along the line 6—6 marked on FIG. 4.

It will be noted particularly from FIG. 2 that the spindle 14 is located eccentrically relative to the axis 48 of rotation of the second component 4. This has the advantage that it permits a wider spacing D from the edge of the door 32 to the edge of the door furniture. Alternatively, the lock case 16 can be made of smaller dimensions and yet the distance L is the same order as in conventional door furniture. The embodiment illustrated in FIGS. 4 to 6 is essentially the same as that illustrated in FIGS. 1 to 3. However, in this arrangement a cylinder lock 50 is mounted in the end cap which is on the exterior side of the door 32. It is possible to locate the cylinder lock 50 in this position since the gear member 10 is located eccentrically with respect to the first and second components 2 and 4 thereby allowing sufficient space to accommodate the key lock 50.

This embodiment also illustrates a different technique for interconnecting the first components 2 of the door furniture. In this arrangement, the screws 36 are omitted and instead each of the first members 2 has a pair of projections 52 extending inwardly therefrom. As best seen in FIG. 6, the projections from the adjacent first components 2 are interlockable and moreover are provided with bores 54 which in use are aligned to thereby permit tie bolts 56 to pass therethrough and so lock the projections 52 together. The tie bolts 56 may comprise the conventional tie bolts which connect the lock cylinder 50 to a mounting plate 58 located in the edge of the door.

FIG. 6 also illustrates a further modification of the invention wherein the spacing rings 8 are omitted and are replaced by threaded rings 60 which are threadably mounted upon threaded inner ends of the first components 2. In this arrangement, the inner ends of the first members 2 bear directly against the lock case 16 and the threaded rings 60 bear against the faces of the door 32 adjacent to the hole 34. It will be appreciated that in this arrangement it is necessary to open the door to gain access to the tie bolts 56 before the door furniture can be removed, thereby decreasing the likelihood of gaining unauthorised entry by disassembly of the door furniture. The rings 60 may be provided with key-ways 62 to tighten them against the faces of the door 32.

FIG. 5 illustrates the inside door furniture which is provided with a locking latch 64 which functions in the conventional manner on the mortice lock 16.

FIGS. 4 to 6 illustrate a relatively small mortice lock case 16 which is possible in the configuration of the invention since it is possible to locate the spindle 14 of the mortice lock closer to the mounting plate 58 because of the eccentric positioning of the components 2 and 4 relative to the spindle 14. In addition, it is possible to vary the gearing ratio between the geared member 10 and the teeth 29 provided on the second component 4 since this permits a reduction in size of the operating member which operates on the bolt of the mortice lock.

In a further embodiment of the invention, the gear 10 is omitted and the recess 12 which accepts the ends of the spindle 14 is formed integrally with the second component 4 or alternatively is located in a member which extends across the interior of the cylindrical body 28. Of course, in such an arrangement the first and second components 2 and 4 are mounted concentrically with respect to the spindle 14 of the mortice lock. Nevertheless, such a lock still has the advantage of the relatively wide diameter co-acting bearing surfaces between the first and second components 2 and 4 as described previously. Of course, the spindle 14 could be omitted and the gear 10 extend fully through the door to achieve unlocking either by direct meshing with a rack formed on the bolt of the door or with gears of the lock which are coupled to the bolt. Alternatively, the gear may be integrally formed with the spindle. In some cases the spindle or other operating member is split so that the door is operable from one side, whilst locked on the other side.

We claim:

1. Door furniture for actuating a spindle operated door lock in a door having a free, said furniture comprising:

a first component for fixedly mounting on the face of the door;

a second component which is rotatable relative to the first component; and coupling means for coupling rotational movement of the second component to the spindle of the door lock;

the first component being located substantially entirely within the second component, wherein the first component includes first and second cylindrical bearing surfaces spaced from one another in the axial direction relative to the spindle of the lock, the second component includes complementary surfaces formed on the interior of the second component, the cylindrical bearing surfaces engaging with the complementary surfaces, and the second component is rotatable about the axes of said surfaces.

2. The door furniture as claimed in claim 1 wherein the coupling means include a body having a recess which is complementary in configuration to the spindle of the door lock, the spindle being engaged within the recess.

3. The door furniture as claimed in claim 2 wherein the body is integrally formed in the second component.

4. The door furniture as claimed in claim 2 wherein the body is mounted for rotation about an axis parallel to the axis of the first component, said body being provided with teeth which engage complementary teeth formed on the interior of the second component.

5. The door furniture as claimed in claim 4 wherein the axis of rotation of the body is spaced from the axis of the cylindrical bearing surfaces.

6. The door furniture as claimed in claim 4 wherein the first component includes a disc portion having a face which has projections which extend away from the face of the door, there being a locking cap supported by the projections which maintains the second component on the first component.

7. The door furniture as claimed in claim 6 wherein the second component comprises a handle.

8. A lock assembly comprising a spindle actuated door lock including a spindle with opposed ends, and the door furniture as claimed in claim 9 coupled to the opposed ends of the spindle.

9. The assembly as claimed in claim 8 wherein the disc portions have inwardly extending fingers which abut one another and which can be connected together by means of tie bolts, the door lock including a latch and the tie bolts extending in the direction of the latch of the door lock.

10. The assembly as claimed in claim 8 wherein the disc portions are connected together by means which extend parallel to the axis of the spindle.

11. The assembly as claimed in claim 8 including spacing rings located in rebates formed in the disc portions and projecting radially outwardly therefrom and adapted to bear against the face of the door.

12. The assembly as claimed in claim 11 wherein the inner ends of the second components bear against said rings.

13. The assembly as claimed in claim 8 including spacing rings which are threadably mounted on the disc portions, said rings having flanges which bear against the face of the door.

14. The assembly as claimed in claim 13 wherein the door lock includes a casing and the inner faces of the disc portions bear against the casing of the door lock.

15. A lock assembly as claimed in claim 4 in which the spindle is integrally formed with said body.

16. The assembly as claimed in claim 8 in which the spindle actuating the lock mechanism is in two pieces so that the handle on one side of the door may operate the lock mechanism while the other handle remains locked.

17. Door furniture for actuating a spindle operated door lock in a door having a face, said furniture comprising:

a first component which is fixedly mounted relative to the face of the door;

a second component which is rotatable relative to the first component about a first axis, the first component being located substantially entirely within the second component; and coupling means for coupling the rotational movement of the second component to the spindle of the door lock, the coupling means being rotatable about a second axis which is parallel to the first axis and spaced therefrom.

18. The door furniture as claimed in claim 17 wherein the first component includes a cylindrical bearing surface, the second component includes a complementary surface formed on the interior of the second component, the cylindrical bearing surface engaging with the complementary surface, and the second component being rotatable about the axes of said surfaces.

19. The door furniture as claimed in claim 18 wherein the second component generally comprises a hollow cylindrical body having an inner surface which constitutes said complementary surface.

20. The door furniture as claimed in claim 18 or 19 wherein the first component cylindrical bearing surface includes a first and a second bearing surface spaced from one another in an axial direction relative to the spindle of the lock.

21. Door furniture as claimed in claim 18 wherein the coupling means include a body having a recess which is complementary in configuration to the spindle of the door lock, the spindle being engaged within the recess.

22. The door furniture as claimed in claim 21 wherein the body is integrally formed in the second component.

23. The door furniture as claimed in claim 21 wherein the body is mounted for rotation about an axis parallel to the axis of the first component, said body being provided with teeth which engage complementary teeth formed on the interior of the second component.

24. The door furniture as claimed in claim 18 wherein the first component includes a disc portion having a face which has projections which extend away from the face of the door, there being a locking cap supported by the projections which maintain the second component on the first component, and wherein said projections provide said cylindrical bearing surface.

25. The door furniture as claimed in claim 19 wherein the second component includes a handle which projects from said cylindrical body.

26. A lock assembly comprising a spindle actuated door lock including a spindle with opposed ends, and the door furniture as claimed in claim 30 coupled to the opposed ends of the spindle.

27. The assembly as claimed in claim 26 wherein the disc portions have inwardly extending fingers which abut one another and which can be connected together by means of tie bolts, the door lock including a latch and the tie bolts extending in the direction of the latch of the door lock.

28. The assembly as claimed in claim 26 wherein the disc portions are connected together by means which extend parallel to the axis of the spindle.

29. The assembly as claimed in claim 26, 27 or 28 including spacing rings located in rebates formed in the disc portions and projecting radially outwardly therefrom and adapted to bear against the face of the door.

30. The assembly as claimed in claim 29 wherein the inner ends of the second components bear against said rings.

31. The assembly as claimed in claim 26, 27 or 28 including spacing rings which are threadably mounted on the disc portions, said rings having flanges which bear against the face of the door.

32. The assembly as claimed in claim 31 wherein the inner faces of the disc portions bear against the casing of the door lock.

33. A lock assembly as claimed in claim 23 in which the spindle is integrally formed with said body provided with teeth.

34. The assembly as claimed in claim 26 in which the spindle actuating the lock mechanism is in two pieces so that the handle on one side of the door may operate the lock mechanism while the other handle remains locked.

* * * * *